US012263994B2

(12) United States Patent
Hanan

(10) Patent No.: US 12,263,994 B2
(45) Date of Patent: Apr. 1, 2025

(54) EXTENDED THREAD TAMPER BAND EVIDENCE

(71) Applicant: Niagara Bottling, LLC, Ontario (CA)

(72) Inventor: Jay Clarke Hanan, Ontario (CA)

(73) Assignee: Niagara Bottling, LLC, Diamond Bar, CA (US)

( * ) Notice: Subject to any disclaimer, the term of this patent is extended or adjusted under 35 U.S.C. 154(b) by 626 days.

(21) Appl. No.: 16/547,484

(22) Filed: Aug. 21, 2019

(65) Prior Publication Data

US 2019/0375558 A1 Dec. 12, 2019

Related U.S. Application Data

(60) Provisional application No. 62/725,969, filed on Aug. 31, 2018.

(51) Int. Cl.

| | |
|---|---|
| ***B65D 41/34*** | (2006.01) |
| ***B65D 55/02*** | (2006.01) |
| *B65D 1/02* | (2006.01) |

(52) U.S. Cl.

CPC ..... *B65D 41/3457* (2013.01); *B65D 41/3428* (2013.01); *B65D 55/024* (2013.01); *B65D 1/0246* (2013.01)

(58) Field of Classification Search

CPC ..... B65D 41/3457; B65D 41/3428; B65D 41/3447; B65D 41/3442; B65D 41/34;

(Continued)

(56) References Cited

U.S. PATENT DOCUMENTS

| | | | |
|---|---|---|---|
| 2,947,432 A | 8/1960 | Marcel | |
| 3,335,889 A | 8/1967 | Brumme | |

(Continued)

FOREIGN PATENT DOCUMENTS

| | | | |
|---|---|---|---|
| BE | 1006399 A7 * | 8/1994 | ..... B65D 1/023 |
| CN | 101234688 A | 8/2008 | |

(Continued)

OTHER PUBLICATIONS

US 11,084,631 B2, 08/2021, Smith (withdrawn)*
International Search Report, dated Dec. 16, 2019, PCT Application No. PCT/US2019/047578.

*Primary Examiner* — J. Gregory Pickett
(74) *Attorney, Agent, or Firm* — Michael Best & Friedrich LLP

(57) ABSTRACT

A tamper evidence closure assembly is provided for engaging with a finish of a container for sealing contents within an interior of a container. The assembly includes a finish and a tamper evidence closure configured to threadably engage with the finish. The finish comprises a cylindrical portion of the container that begins at an opening to the interior of the container and extends to and includes a support ledge. Threads are configured to engage with the finish. The tamper evidence closure includes a tamper evidence band that is attached to closure by way of a multiplicity of thin connections. The tamper evidence band includes a cam configured to engage with the finish during removal of the tamper evidence closure. The cam causes the thin connections to break such that the tamper evidence band remains disposed on the finish after removal of the tamper evidence closure.

4 Claims, 2 Drawing Sheets

(58) Field of Classification Search
CPC .. B65D 41/0414; B65D 41/32; B65D 55/024; B65D 55/022; B65D 1/0246; B65D 1/0238; B65D 1/023
See application file for complete search history.

(56) References Cited

U.S. PATENT DOCUMENTS 3,684,118 A 8/1972 Brumme
3,746,201 A 7/1973 Fujio
3,773,205 A 11/1973 Keller et al.
3,809,365 A 5/1974 Loffler
3,850,328 A 11/1974 Guala
3,901,403 A 8/1975 Menke
4,007,848 A * 2/1977 Snyder ..... B65D 41/348 215/44
4,037,281 A * 7/1977 Reynolds ..... F16B 33/02 470/10
4,046,013 A * 9/1977 Green ..... G01N 1/10 73/863.81
4,197,955 A 4/1980 Luenser
4,244,068 A * 1/1981 Hellnick ..... B23G 1/06 408/188
4,295,760 A * 10/1981 Warner ..... E21D 21/008 411/75
4,302,036 A * 11/1981 Burge ..... B60T 17/043 285/914
4,436,212 A * 3/1984 Alejandro Llera ..... B29C 45/2618 215/252
4,530,438 A * 7/1985 McDevitt ..... B65D 41/3447 215/252
4,552,387 A * 11/1985 Schmidt ..... F16L 33/225 285/190
4,567,991 A 2/1986 Anderson
4,579,241 A * 4/1986 Hayes ..... B65D 41/3447 215/252
4,674,643 A 6/1987 Wilde et al.
4,729,488 A * 3/1988 Bullock, III ..... B65D 41/32 215/256
4,744,478 A * 5/1988 Hahn ..... B65D 41/0407 215/252
4,744,479 A * 5/1988 Schottli ..... B65D 41/3452 215/252
4,744,480 A 5/1988 Luch et al.
4,813,561 A * 3/1989 Ochs ..... B65D 41/3409 215/276
4,895,265 A 1/1990 Luch et al.
4,927,680 A 5/1990 Collette et al.
5,009,324 A 4/1991 Ochs
5,031,787 A * 7/1991 Ochs ..... B65D 51/1661 215/276
5,068,494 A * 11/1991 Bolante ..... H02G 3/0675 285/341
5,097,974 A 3/1992 Rozenberg
5,103,991 A 4/1992 Collins
5,137,163 A * 8/1992 Moore ..... B65D 41/3447 215/252
5,213,225 A 5/1993 King et al.
5,248,050 A 9/1993 Janousch et al.
5,314,084 A * 5/1994 Folta ..... B65D 51/241 215/249
5,360,126 A 11/1994 Snyder et al.
5,360,239 A * 11/1994 Klementich ..... F16L 15/001 285/422
5,487,481 A * 1/1996 Sander ..... B65D 41/3447 215/252
5,494,174 A * 2/1996 Rohr ..... B65D 55/02 215/330
5,509,552 A 4/1996 Eguchi et al.
5,511,677 A 4/1996 Oder
5,597,082 A * 1/1997 Luch ..... B65D 47/121 220/276
5,603,422 A 2/1997 Herrmann
5,740,932 A 4/1998 Bettegazzore
5,743,419 A * 4/1998 King ..... B65D 41/0471 215/217
5,749,201 A 5/1998 Cochrane
5,915,579 A 6/1999 Przytulla et al.
6,158,603 A * 12/2000 Price ..... B65D 41/0471 215/44
6,322,110 B1 * 11/2001 Banker ..... E21B 17/0423 285/333
6,382,444 B1 * 5/2002 Nyman ..... B65D 41/0471 215/218
6,523,710 B1 2/2003 Hidding et al.
6,938,787 B2 * 9/2005 Shinozaki ..... B65D 41/3452 215/252
7,510,094 B1 * 3/2009 Willis ..... B65D 50/043 215/218
7,637,384 B2 12/2009 Price et al.
7,819,264 B2 * 10/2010 Brozell ..... B65D 50/043 215/222
8,141,793 B2 * 3/2012 Wallis ..... A61L 9/048 239/55
8,268,216 B2 * 9/2012 Meador ..... B29C 70/80 264/268
8,528,759 B2 * 9/2013 Pucci ..... B65D 51/1622 215/253
8,794,461 B2 8/2014 Major
9,221,596 B2 * 12/2015 Patel ..... B65D 1/0246
9,815,604 B2 11/2017 Ekkert
9,994,350 B2 * 6/2018 Labadie ..... B65D 1/0246
10,377,534 B2 8/2019 Hanan
10,919,671 B2 2/2021 Hanan
11,021,302 B2 * 6/2021 Edie ..... B65D 41/0421
11,345,526 B2 * 5/2022 Erickson ..... B65D 47/123
2001/0000602 A1 5/2001 Luch
2002/0030031 A1 * 3/2002 Druitt ..... B65D 41/3447 215/252
2002/0134747 A1 9/2002 Babcock et al.
2003/0127418 A1 * 7/2003 Schweigert ..... B65D 41/3447 215/252
2004/0035818 A1 * 2/2004 King ..... B65D 41/0471 215/330
2005/0048235 A1 * 3/2005 Dygert ..... B29C 49/0073 428/35.7
2005/0079027 A1 * 4/2005 Ernst ..... F16B 37/127 411/44
2005/0115294 A1 * 6/2005 Kanou ..... B65D 1/42 72/121
2005/0150856 A1 * 7/2005 Ozawa ..... B65D 1/0246 215/44
2006/0021959 A1 * 2/2006 Falzoni ..... B65D 41/3428 215/252
2006/0169666 A1 * 8/2006 Nyman ..... B65D 1/0246 215/252
2007/0023299 A1 * 2/2007 Clarkson ..... B65D 51/2835 206/219
2007/0034591 A1 * 2/2007 Flak, Jr. ..... B65D 1/0246 215/252
2008/0014047 A1 * 1/2008 Dohi ..... F16B 35/041 411/387.4
2008/0073382 A1 3/2008 Higgins
2008/0116162 A1 5/2008 Penny
2008/0197102 A1 8/2008 Farrar et al.
2008/0257855 A1 10/2008 Patel
2009/0084751 A1 * 4/2009 Pucci ..... B65D 41/325 215/217
2010/0314348 A1 12/2010 Zoppas et al.
2011/0024423 A1 * 2/2011 Erspamer ..... B65D 41/3428 220/266
2011/0117522 A1 * 5/2011 Verma ..... A61C 8/0025 433/174
2011/0278313 A1 * 11/2011 Labadie ..... B65D 1/0246 220/669
2012/0091091 A1 4/2012 Steinberger
2012/0091134 A1 4/2012 Sadiq et al.
2012/0263902 A1 10/2012 Hanan
2012/0305516 A1 * 12/2012 Kuzma ..... B65D 1/0246 215/44

(56) References Cited

U.S. PATENT DOCUMENTS

| | | | | |
|---|---|---|---|---|
| 2013/0047797 | A1* | 2/2013 | Lukes | F16B 23/003 81/460 |
| 2013/0102992 | A1* | 4/2013 | Domkowski | B65B 3/003 604/416 |
| 2013/0213923 | A1* | 8/2013 | Krautkramer | B65D 41/348 215/252 |
| 2014/0008320 | A1* | 1/2014 | Hosoi | B21D 51/26 29/592 |
| 2016/0193750 | A1 | 7/2016 | Gaiotti et al. | |
| 2017/0107020 | A1* | 4/2017 | Vanon | B65D 1/0246 |
| 2017/0217646 | A1 | 8/2017 | Hanan | |
| 2018/0044072 | A1* | 2/2018 | Asakawa | B65D 41/0421 |
| 2018/0229881 | A1* | 8/2018 | Jarman | B65D 1/023 |
| 2018/0297752 | A1 | 10/2018 | Mai | |
| 2018/0327131 | A1* | 11/2018 | Hanan | B65D 1/023 |
| 2019/0040897 | A1* | 2/2019 | Vorderwisch | F16B 25/0052 |
| 2019/0367203 | A1 | 12/2019 | Okuyama et al. | |
| 2019/0375556 | A1* | 12/2019 | Hanan | B65D 1/0246 |
| 2020/0031531 | A1* | 1/2020 | Hanan | B65D 41/38 |
| 2020/0071035 | A1* | 3/2020 | Hanan | B29B 11/14 |
| 2020/0095007 | A1 | 3/2020 | Jarman et al. | |
| 2020/0198855 | A1* | 6/2020 | Sterling | B65D 50/043 |
| 2021/0031962 | A1* | 2/2021 | Hanan | B65D 1/0246 |
| 2021/0031986 | A1* | 2/2021 | Gerber | B65D 41/3428 |
| 2021/0047084 | A1* | 2/2021 | Kim | B65D 43/169 |
| 2022/0055804 | A1* | 2/2022 | Khattar | B65D 41/3428 |
| 2022/0177198 | A1* | 6/2022 | Hossain | B65D 41/3428 |

FOREIGN PATENT DOCUMENTS

| | | | | | |
|---|---|---|---|---|---|
| CN | 106542191 | A | | 3/2017 | |
| DE | 102019007143 | A1 | * | 4/2021 | B65D 41/3442 |
| EP | 2687450 | A1 | | 1/2014 | |
| FR | 1491263 | A | * | 8/1967 | B65D 50/046 |
| JP | H072263 | A | | 1/1995 | |
| JP | H07149357 | A | | 6/1995 | |
| JP | 2006232392 | A | * | 9/2006 | B65D 1/023 |
| JP | 2010285162 | A | | 12/2010 | |
| WO | WO-9728057 | A1 | * | 8/1997 | B65D 51/1688 |
| WO | WO-2005073096 | A1 | * | 8/2005 | B65D 1/0246 |
| WO | WO2009122144 | A1 | | 10/2009 | |
| WO | WO2015189436 | A1 | | 12/2015 | |
| WO | WO-2017183952 | A1 | * | 10/2017 | B65D 41/00 |
| WO | WO-2020175123 | A1 | * | 9/2020 | B65D 41/0421 |
| WO | WO-2020245250 | A1 | * | 12/2020 | B65D 55/16 |
| WO | WO-2021005505 | A1 | * | 1/2021 | B65D 55/16 |

* cited by examiner

EXTENDED THREAD TAMPER BAND EVIDENCE

PRIORITY

This application claims priority to U.S. Provisional Patent Applications No. 62/721,484, filed Aug. 22, 2018, titled "Extended Thread Tamper Band Evidence," and U.S. Provisional Patent Applications No. 62/725,969, filed Aug. 31, 2018, titled "Extended Thread Finish and Tamper Evidence Closure," the disclosures of which are hereby incorporated herein by reference in their entirely.

FIELD

Embodiments of the present disclosure generally relate to the field of plastic bottles and preforms. More specifically, embodiments of the disclosure relate to tamper evidence container caps that provide visible indications of removal of the container caps after installation by a manufacturer.

BACKGROUND

Plastic containers have been used as a replacement for glass or metal containers in the packaging of beverages for several decades. The most common plastic used in making beverage containers today is polyethylene terephthalate (PET). Containers made of PET are transparent, thin walled, and have the ability to maintain their shape by withstanding the force exerted on the walls of the container by their contents. PET resins are also reasonably priced and easy to process. PET bottles are generally made by a process that includes the blow-molding of plastic preforms which have been made by injection molding of the PET resin.

Advantages of plastic packaging include lighter weight and decreased breakage as compared to glass, and lower costs overall when taking both production and transportation into account. Although plastic packaging is lighter in weight than glass, there is still great interest in creating the lightest possible plastic packaging so as to maximize the cost savings in both transportation and manufacturing by making and using containers that contain less plastic.

A plastic container for storing liquid contents typically includes a base that extends up to a grip portion suitable for affixing a label, as well as providing a location for grasping the container. The grip portion generally transitions into a shoulder, which connects to a bell. The bell has a diameter that generally decreases as the bell extends upward from the shoulder to a neck and a finish. The finish is adapted to receive a closure, such as a bottle cap, to seal the contents within the interior of the plastic container.

In many instances, the closure includes a tamper evidence band that is disposed around the perimeter of the finish. The tamper evidence band generally remains positioned on the finish when an end-user loosens the closure to access the contents within the container. As such, the tamper evidence band and the finish cooperate to indicate to the end-user whether or not the closure has been previously loosened after being installed by the manufacturer.

A drawback to conventional tamper evidence bands, however, is that in some instances the tamper evidence bands fail to detach from the closure upon being loosened, thereby making it difficult for an end-user to directly observe whether or not the closure has been previously separated from the container. Consequently, the closure may be separated from the tamper evidence band, the container may be refilled, and another closure may be installed onto the container, giving little visual indication to the end-user that the container has been reused.

What is needed, therefore, is a tamper evidence closure that reliably provides a visible indication about whether or not a manufacturer-installed closure has been previously removed from a plastic container.

SUMMARY

Systems and methods for finishes rotatably engaging with a closure so as to seal contents within the interior of a container in accordance with embodiments of the invention are disclosed. In one embodiment, the finish includes a cylindrical body that begins at an opening to an interior of the container and extends to and includes a support ledge, one or more threads configured to provide a means to fasten the closure to the container, a bottom-most thread that extends into a parallel relationship with the support ledge, and a gap disposed between the bottom-most thread and the support ledge.

In a further embodiment, the one or more the threads are configured to rotatably engage with similar threads disposed within the closure to provide a way to seal contents within the container.

In another embodiment, each of the one or more threads extends along a section of the circumference of the finish and approaches the support ledge.

In a further embodiment, when the threads of the closure are engaged with the one or more threads and the closure is rotated in a clockwise direction, the closure advances toward the support ledge.

In a still further embodiment, the one or more threads comprise a single thread that begins at a thread start and spirals around the circumference of the finish before terminating at a thread end.

In a yet further embodiment, the thread start is configured to guide a thread of the closure into a valley between adjacent portions of the single thread so as to threadably engage the closure with the finish.

In yet another embodiment, adjacent portions of the single thread are spaced uniformly around the circumference of the finish.

In a further embodiment again, the bottom-most thread is substantially parallel with the support ledge.

In another embodiment again, the gap includes a roughly uniform width around the circumference of the finish and is configured to retain a tamper evidence band including the closure.

In a further additional embodiment, the closure includes interior threads that are configured to engage with the one or more threads of the finish.

In another additional embodiment, the closure includes a plug seal configured to extend into the opening and enter into a pressed relationship with the finish whereby contents are sealed in the interior of the container.

In a still yet further embodiment, the closure includes a tamper evidence band disposed around the circumference of the closure and attached to the closure by way of a multiplicity of thin connections.

In still yet another embodiment, the tamper evidence band includes a cam that includes an angled lower surface configured to facilitate passing the tamper evidence band over the one or more threads during assembly of the closure onto the container.

In a still further embodiment again, the cam includes a continuous shape that extends around the circumference of the tamper evidence band.

In still another embodiment again, the cam includes an upper surface that is configured to engage with the bottom-most thread so as to retain the tamper evidence band positioned within the gap during loosening of the closure, the multiplicity of thin connections breaking during loosening of the closure.

In still further additional embodiment, the tamper evidence band is configured to remain positioned below the bottom-most thread after the closure is removed from the container, thereby indicating that the closure has been loosened after being installed by a manufacturer.

In still another additional embodiment, friction between the cam and the bottom-most thread retains the cam within the gap once the closure is loosened from the finish.

In a yet further embodiment again, the bottom-most thread and the one or more threads comprise a substantially similar diameter of the finish, such that friction between the closure and the bottom-most thread contributes to detaching the tamper evidence band from the closure during loosening of the closure from the finish.

In a number of embodiments, a tamper evidence closure for rotatably engaging with a finish of a container to seal contents within the interior of the container includes interior threads that are configured to engage with threads of the finish, a plug seal configured to extend into an opening of the finish whereby contents are sealed in the interior of the container, a multiplicity of thin connections attaching a tamper evidence band to a circumference of the tamper evidence closure, and a cam including a continuous cross-sectional shape of the tamper evidence band extending around the circumference of the tamper evidence band.

In yet another embodiment again, the cam includes an angled lower surface configured to facilitate passing the tamper evidence band over the threads of the finish during assembly of the tamper evidence closure onto the container.

In yet further additional embodiment, the cam includes an upper surface configured to engage with a bottom-most thread of the finish so as to retain the tamper evidence band positioned on the finish during loosening of the tamper evidence closure, the multiplicity of thin connections breaking during loosening of the tamper evidence closure.

In a variety of embodiments, a tamper evidence closure assembly for sealing contents within an interior of a container includes a finish including a cylindrical portion of the container that begins at an opening to the interior of the container and extends to and includes a support ledge, a tamper evidence closure configured to threadably engage with the finish, the tamper evidence closure including a tamper evidence band, and a cam including the tamper evidence band and configured to engage with the finish during removal of the tamper evidence closure so as to cause the tamper evidence band to remain disposed on the finish after removal of the tamper evidence closure.

In yet another additional embodiment, the tamper evidence band is attached to the circumference of the tamper evidence closure by way of a multiplicity of thin connections that are configured to break during loosening of the tamper evidence closure.

In a further additional embodiment again, the cam includes an angled lower surface configured to facilitate passing the tamper evidence band over one or more threads including the finish during assembly of the tamper evidence closure onto the container.

In another additional embodiment again, the cam includes a continuous shape that extends around the circumference of the tamper evidence band.

In a still yet further embodiment again, the cam includes an upper surface that is configured to engage with a bottom-most thread of the finish so as to retain the tamper evidence band positioned below the bottom-most thread during loosening of the closure, the multiplicity of thin connections breaking during loosening of the closure.

In still yet another embodiment again, friction between the cam and the bottom-most thread retains the cam below the bottom-most thread once the tamper evidence closure is loosened from the finish.

In a still yet further additional embodiment, the tamper evidence band is bonded to the support ledge such that the tamper evidence band remains fixated to the support ledge during loosening the tamper evidence closure on the finish, the multiplicity of thin connections breaking during loosening of the closure.

In still yet another additional embodiment, the tamper evidence band is bonded to the support ledge by way of an adhesive.

In a yet further additional embodiment again, the adhesive is any one of a hot melt adhesive, a Cyanoacrylate, a UV-cured adhesive, and 2-part epoxy.

In yet another additional embodiment again, the tamper evidence band is bonded to the support ledge by way of ultrasonic welding.

In a still yet further additional embodiment again, the tamper evidence band is bonded to the support ledge such that the tamper evidence band remains fixated to the support ledge during loosening the tamper evidence closure on the finish, the multiplicity of thin connections breaking during loosening of the closure.

In still yet another additional embodiment again, the tamper evidence band is bonded to the support ledge by way of an adhesive.

In another further embodiment, the adhesive is any one of a hot melt adhesive, a Cyanoacrylate, a UV-cured adhesive, and 2-part epoxy.

In still another further embodiment, the tamper evidence band is bonded to the support ledge by way of ultrasonic welding.

In one embodiment, the finish includes one or more threads configured to provide a means to fasten the closure to the container, a bottom-most thread that extends into a parallel relationship with the support ledge, and a gap disposed between the bottom-most thread and the support ledge.

In yet another further embodiment, the gap includes a roughly uniform width around the circumference of the finish and is configured to retain the tamper evidence band.

In another further embodiment again, the bottom-most thread and the one or more threads comprise a substantially similar diameter of the finish, such that friction between the cam and the bottom-most thread causes the tamper evidence band to detach from the tamper evidence closure during loosening on the finish.

In a further embodiment, the one or more the threads are configured to rotatably engage with similar threads disposed within the closure to provide a way to seal contents within the container.

In another embodiment, each of the one or more threads extends along a section of the circumference of the finish and approaches the support ledge.

In a still further embodiment, the one or more threads comprise a single thread that begins at a thread start and spirals around the circumference of the finish before terminating at a thread end.

In still another embodiment, the thread start is configured to guide a thread of the closure into a valley between adjacent portions of the single thread so as to threadably engage the closure with the finish.

In a yet further embodiment, adjacent portions of the single thread are spaced uniformly around the circumference of the finish.

BRIEF DESCRIPTION OF THE DRAWINGS

The drawings refer to embodiments of the present disclosure in which.

Figure 1:
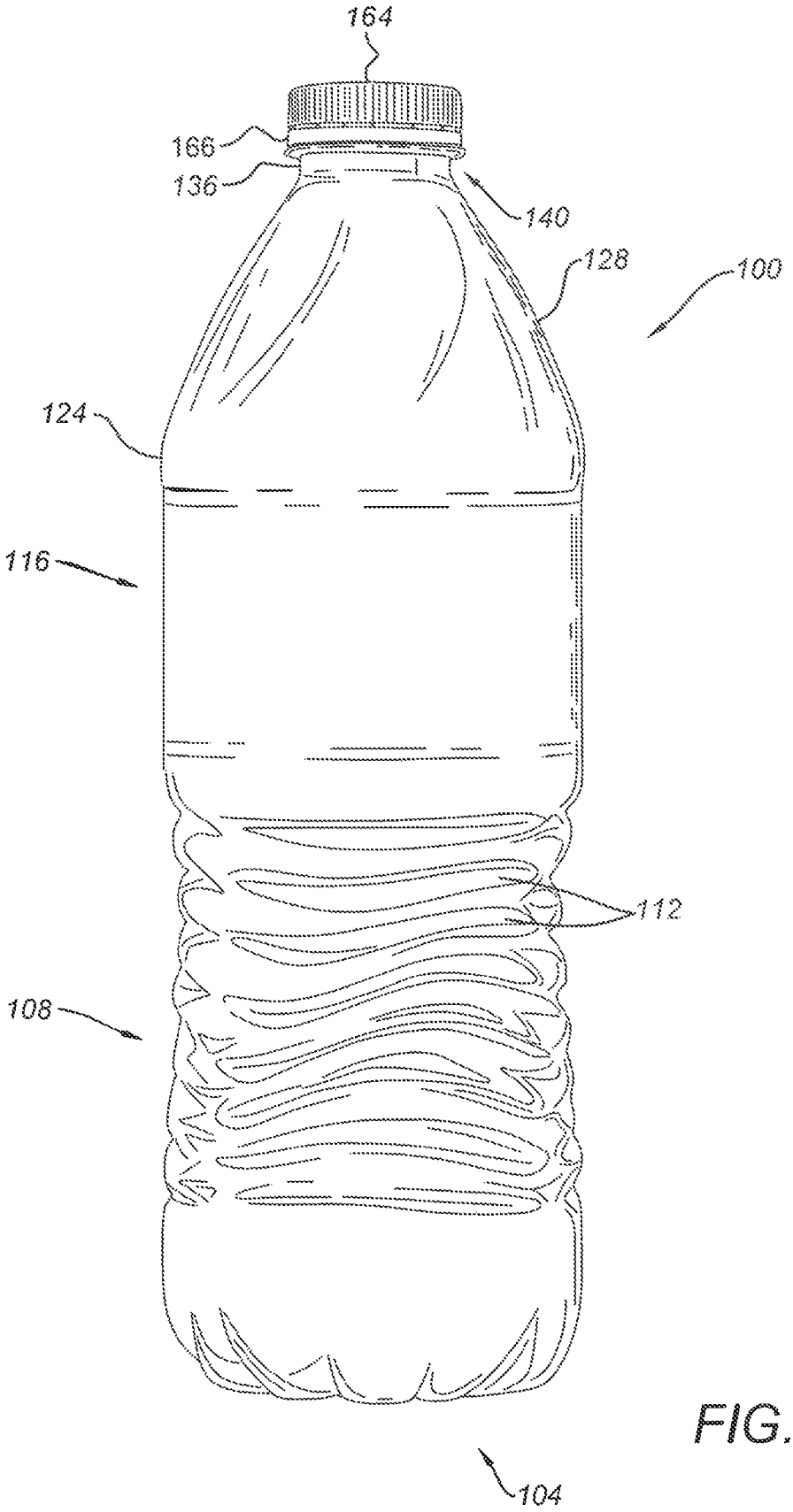
FIG. 1 illustrates a side view of an exemplary container suitable for storing a beverage.

While the present disclosure is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide q thorough understanding of the present disclosure. It will be apparent, however, to one of ordinary skill in the art that the invention disclosed herein may be practiced without these specific details. In other instances, specific numeric references such as "first bottle," may be made. However, the specific numeric reference should not be interpreted as a literal sequential order but rather interpreted that the "first bottle" is different than a "second bottle." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

In some instances, conventional tamper evidence bands fail to detach from the closure upon being loosened, thereby making it difficult for an end-user to directly observe whether or not the closure has been previously separated from the container. Consequently, the end-user has little visual indication of whether the container has been reused. Embodiments disclosed herein provide a tamper evidence closure that reliably provides a visible indication about whether or not a manufacturer-installed closure has been previously removed from a plastic container.

FIG. 1 illustrates a side view of an exemplary container 100 typically used for storing liquid contents, such as water and juice. The container 100 comprises a base 104 that extends up to a grip portion 108. In some embodiments, the base 104 may be of the petaloid variety, although other configurations of the base may be incorporated into the container 100, without limitation. The grip portion 108 comprises a plurality of grip portion ribs 112 (i.e., sidewall ribs). As illustrated in FIG. 1, the plurality of grip portion ribs 112 generally vary in depth, and swirl or angulate around the grip portion 108. A label portion 116 can be connected to the grip portion 108 and comprises one or more label panel ribs (not shown). The label panel portion 116 transitions into a shoulder 124, which connects to a bell 128. The bell 128 connects to a neck 136, which connects to a finish 140. As shown in FIG. 1, the bell 128 comprises a diameter that generally decreases as the bell 128 extends upward from the shoulder 124 to the neck 136 and the finish 140. The finish 140 can be adapted to receive a closure 164, such as by way of non-limiting example, a container cap or bottle cap, so as to seal contents within the container 100. The finish 140 generally defines an opening 160 that leads to an interior of the container 100 for containing a beverage, or other contents, such as any of a variety of carbonated soft drinks.

Figure 2:
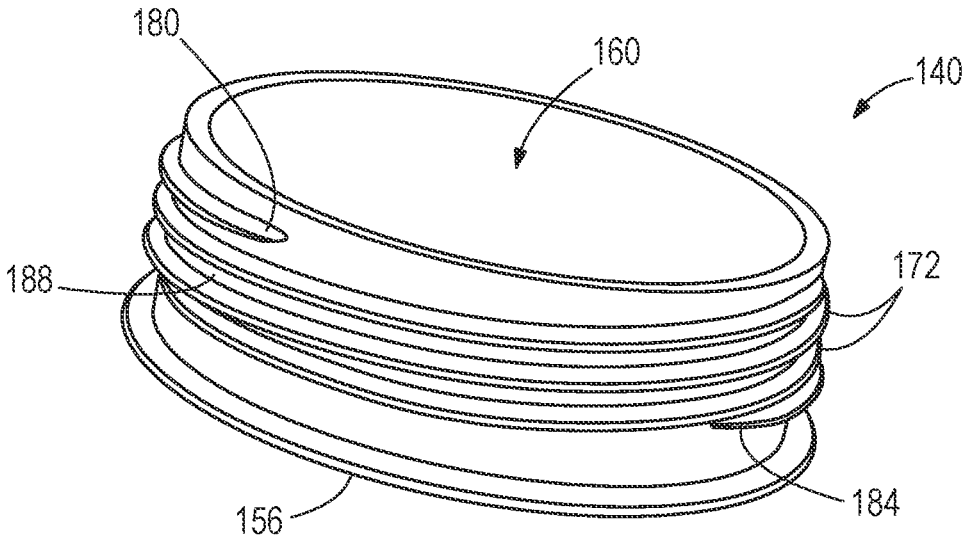
FIG. 2 illustrates an upper perspective view of an exemplary embodiment of a finish including extended threads.

FIG. 2 illustrates an upper perspective view of an exemplary finish 140 that may be configured to rotatably engage with the closure 164 so as to seal contents within the interior of the container 100. The finish 140 comprises a cylindrical body that begins at an opening 160 to an interior of the container 100 and extends to and includes a support ledge 156. The finish 140 can be further characterized by the presence of one or more threads 172 configured to provide a means to fasten the closure 164 to the container 100. As such, the threads 172 are configured to rotatably engage with similar threads disposed within the closure 164 to provide a way to seal contents within the container 100. In the embodiment illustrated in FIG. 2, each of the threads 172 generally extends along a section of the circumference of the finish 140 and approaches the support ledge 156. Thus, when the threads of the closure 164 are engaged with the threads 172, and the closure 164 can be rotated in a clockwise direction, the closure advances toward the support ledge 156.

Figure 3:
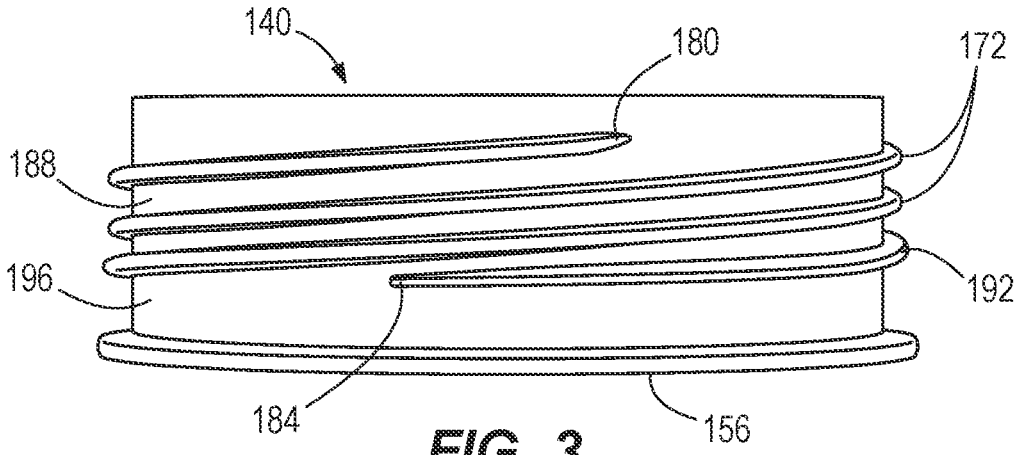
FIG. 3 illustrates side view of the finish illustrated in FIG. 2.

In the embodiment illustrated in FIGS. 2-3, the threads 172 comprise a single thread 172 that begins at a thread start 180 and spirals around the circumference of the finish 140 before terminating at a thread end 184. The thread start 180 can be configured to guide a thread 176 of the closure 164 into a space, or valley 188, between adjacent threads 172 so as to threadably engage the closure 164 with the finish 140. Further, the threads 172 generally are disposed adjacently to one another and are spaced uniformly around the circumference of the finish 140, with the exception of a bottom-most thread 192. As best shown in FIG. 3, the bottom-most thread 192 extends into a parallel relationship with the support ledge 156, thereby forming a gap 196 therebetween. The gap 196 includes a roughly uniform width around the circumference of the finish 140 and may be configured to retain a tamper evidence band of the closure 164, as discussed herein.

Figure 4:
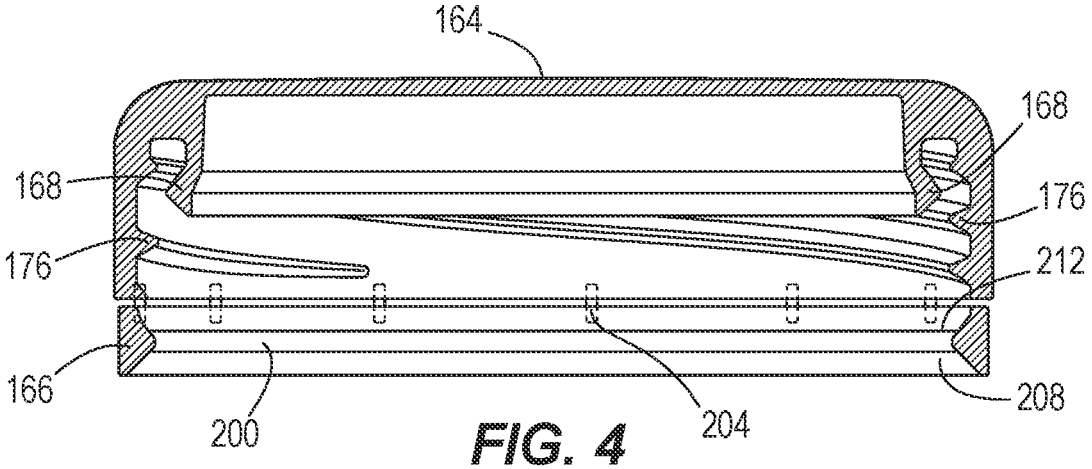
FIG. 4 illustrates a cross-sectional view of a closure that is configured to be threadably engaged with the finish shown in FIGS. 2-3.

FIG. 4 illustrates a cross-sectional view of a closure 164 that may be threadably engaged with the finish 140 shown in FIGS. 2-3. As shown in FIG. 4, the closure 164 includes interior threads 176 that are configured to engage with the threads 172 of the finish 140, as described above. As such, the threads 176 extends into the thread valleys 188 extending around the finish 140. During tightening of the closure 164 onto the finish 140, a plug seal 168 of the closure 164 can be configured to extend into the opening 160 and enter into a pressed relationship with the finish 140 whereby contents are sealed in the interior of the container 100.

As further shown in FIG. 4, the closure 164 includes a tamper evidence band 166 that includes a cam 200 and can be disposed around the perimeter of the closure 164 and may be attached to the closure 164 by a multiplicity of thin connections 204. The cam 200 generally comprises an angled lower surface 208 configured to facilitate passing the tamper evidence band 166 over the threads 172 during assembly of the closure 164 onto the container 100. A relatively flat upper surface 212 of the cam can be configured to engage with the bottom-most thread 192 of the finish 140 and thus retain the tamper evidence band 166 positioned within the gap 196 below the bottom-most thread 192 during loosening of the closure 164. For example, when an end-user loosens the closure 164, the cam 200 presses against the bottom-most thread 192, breaking the thin connections 204 between tamper evidence band 166 and the closure 164. The tamper evidence band 166 remains positioned below the bottom-most thread 192 after the closure 164 can be removed from the container 100. Thus, the tamper evidence band 166 cooperates with the bottom-most thread 192 to indicate to the end-user that the closure 164 has not been previously loosened after being installed by the manufacturer.

In the embodiment illustrated in FIGS. 2-3, the bottom-most thread 192 comprises a diameter of the finish 140 that may be greater than the diameter of the other threads 172. It is contemplated, however, that in some embodiments the bottom-most thread 192 and the other threads 172 comprise substantially the same diameter of the finish 140, without limitation. In such embodiments, friction between the closure 164 and the threads 172, 192 contributes to detaching the tamper evidence band 166 from the closure 164 when the end-user twists the closure. Further, as shown in FIG. 4, the cam 200 comprises a continuous shape that extends around the circumference of the tamper evidence band 166. As such, friction between the cam 200 and the bottom-most thread 192 retains the cam within the gap 196 once the closure 164 is loosened from the finish 140.

In some embodiments, the tamper evidence band 166 may be bonded to the support ledge 156, such that the tamper evidence band 166 remains fixated to the support ledge 156 during loosening of the tamper evidence closure 164 on the finish. As such, when an end-user loosens the tamper evidence closure 164 on the finish 140, the multiplicity of thin connections 204 break, leaving the tamper evidence band 166 attached to the finish 140 when the closure 164 can be removed. It is contemplated that the tamper evidence band 166 may be bonded to the support ledge 156 by way of any of various suitable adhesives, such as any of hot melt adhesives, a Cyanoacrylates, UV-cured adhesives, and 2-part epoxies. Further, in some embodiments, the tamper evidence band 166 may be bonded to the support ledge 156 by way of ultrasonic welding.

While the invention has been described in terms of particular variations and illustrative figures, those of ordinary skill in the art will recognize that the invention is not limited to the variations or figures described. In addition, when methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. To the extent there are variations of the invention, which are within the spirit of the disclosure or equivalent to the inventions found in the claims, it is the intent that this patent will cover those variations as well. Therefore, the present disclosure is to be understood as not limited by the specific embodiments described herein, but only by scope of the appended claims.

What is claimed is:

1. A tamper evidence closure assembly for sealing contents within an interior of a container, the assembly comprising:

a finish including a cylindrical body having an edge defining an opening to the interior of the container, and one or more threads configured to rotatably engage the closure with the container, wherein the thread of the one or more threads furthest from the opening extends into a circumferentially parallel relationship with the edge; and a tamper evidence closure configured to threadably engage with the finish, the tamper evidence closure including a tamper evidence band in the form of a cam configured to engage with the finish during removal of the tamper evidence closure, wherein the cam includes a surface configured to engage with the thread of the one or more threads furthest from the opening to retain the tamper evidence band positioned below the thread during loosening of the closure.

2. The assembly of claim 1, wherein the tamper evidence closure includes a plurality of connections coupled to the tamper evidence band and configured to break during loosening of the tamper evidence closure.

3. The assembly of claim 2, wherein the cam comprises an angled surface configured to facilitate passing the tamper evidence band over the one or more threads during assembly of the tamper evidence closure onto the container.

4. The assembly of claim 1, wherein the thread of the one or more threads furthest from the opening has a diameter greater than any other thread of the one or more threads.

* * * * *